US011130167B2

(12) United States Patent
Roden, Jr. et al.

(10) Patent No.: US 11,130,167 B2
(45) Date of Patent: Sep. 28, 2021

(54) AXIAL THREAD ROLLING

(71) Applicants: William M. Roden, Jr., Charlotte, NC (US); Richard A. Hagenbuch, Charlotte, NC (US)

(72) Inventors: William M. Roden, Jr., Charlotte, NC (US); Richard A. Hagenbuch, Charlotte, NC (US)

(73) Assignee: TURNING CONCEPTS, LLC, Matthews, NC (US)

( * ) Notice: Subject to any disclaimer, the term of this patent is extended or adjusted under 35 U.S.C. 154(b) by 351 days.

(21) Appl. No.: 16/387,157

(22) Filed: Apr. 17, 2019

(65) Prior Publication Data

US 2020/0331055 A1 Oct. 22, 2020

(51) Int. Cl.
*B21H 3/04* (2006.01)

(52) U.S. Cl.
CPC ..... *B21H 3/044* (2013.01)

(58) Field of Classification Search
CPC . B21H 3/02; B21H 3/04; B21H 3/042; B21H 3/044; B21H 3/046; B21H 3/048
USPC ..... 72/469
See application file for complete search history.

(56) References Cited

U.S. PATENT DOCUMENTS

| | | | | |
|---|---|---|---|---|
| 2,909,087 A | 10/1956 | Powell | | |
| 3,972,213 A * | 8/1976 | Habegger | ..... | B21H 3/046 72/104 |
| 5,568,743 A | 10/1996 | Oppelt | | |
| 2015/0165512 A1* | 6/2015 | Gutsche | ..... | B21H 3/044 72/37 |

* cited by examiner

*Primary Examiner* — Debra M Sullivan
(74) *Attorney, Agent, or Firm* — Timothy R Kroboth

(57) ABSTRACT

The present invention is directed to an axial thread rolling process that utilizes a thread rolling head that includes a clutch, that prevents full disengagement of the clutch during thread rolling, and that reverses the direction of rotation used for thread rolling to escape a threaded workpiece from the thread rolling head.

17 Claims, 3 Drawing Sheets

AXIAL THREAD ROLLING

FIELD OF THE INVENTION

The present invention relates to thread rolling heads and the related systems that perform axial thread rolling.

BACKGROUND OF THE INVENTION

Components that require outer diameter threads often have those threads created by means of material displacement by rolling systems or rolling heads. This process is generally known as "thread rolling." Thread rolling can be performed on manual, multi-spindle screw machines or computer numerically controlled (CNC) machines. There are three types of thread rolling: axial, radial and tangential, each of which is accomplished with a different type head.

Axial thread rolling can be performed on screw machines on which the spindle only rotates in one direction. However, most CNC machines have the ability to rotate the spindle in either direction.

With reference to U.S. Pat. No. 2,909,087 to Powell and to U.S. Pat. No. 5,568,743 to Oppelt and in particular to the description of the device of prior art FIG. 1 of the '743 patent, self-opening thread rolling heads are known. The axial thread rolling heads of these patents include a claw clutch that opens and must be re-closed before thread rolling the next workpiece. These heads use three profile rollers rotatably arranged 120° apart. This type of prior art thread rolling process is sometimes referred to as the "Pop Open" process.

Prior art FIG. 1 of the '743 patent and the description of the device of prior art FIG. 1 set forth in columns 3 and 4 of the '743 patent, are hereby incorporated by reference into this description. Additional details of, and relating to, that description of the '743 patent are now provided, in particular with respect to use of the axial thread rolling head of prior art FIG. 1.

The thread rolling head is twisted closed forcing clutch claw (30) and the clutch claw on the back of spring housing (2) into seated engagement. Pin (9) is used for leverage if needed. Profile rollers (18) are loaded on eccentric shafts (5) by removing cap screws (14) and face plate (4). Shank (1) may have a flat the length of the shank on the outside diameter for securing the shank to a machine tool.

Thread rolling requires a preset distance between rollers (18). A gauge pin is inserted into the rolls after locking nuts (15) are loosened. An alternative method is to screw a known good thread (Master) into the rolls. Spring housing (2) is rotated until setting gauge pin or master thread is "snug". Locking nuts (15) are then tightened. In this way, the thread depth and thread profile are set.

The thread rolling head is inserted into a machine tool, and shank (1) is clamped in position normally, but not always, by set screws. After clamping, shank (1) and clutch claw (30) become axially fixed. The thread rolling head is now under machine tool axis control by various methods dependent on machine tool design.

The thread rolling head is positioned on the axial or centerline of the machine tool with the shank (1) and bearing unit LE being coaxial. The thread rolling head can move axially under machine tool control. The thread rolling head (either rotating or rotatably stationary) is fed under controlled feed rate into the workpiece. The workpiece is guide d between rollers (18), and after the workpiece material changes state and experiences plasticity, the rollers "pull" through the material based on the ground pitch in the rollers.

After the desired length of thread is generated, the user stops feeding the thread rolling head. With fixed claw (30) axially stationary but the movable clutch claw continuing to move with spring housing (2), the movable and fixed claws separate.

Upon completion of thread rolling a workpiece, it is necessary to disengage the profile rollers from the workpiece to escape the thread rolling head without thread damage. The profile rollers are on eccentric shafts, the rotation of which results in a change of the distance between the profile rollers. Secured to the eccentric shafts (5) are small gear wheels (8) meshing with a central gear wheel (7). The central gear wheel (7), which is arranged on splined end (34) of the shank, cannot rotate until the two parts of the claw clutch separate. Spring housing (2) contains a helical spring (10) having one end secured to movable spring housing (2) and the other end secured to the fixed clutch claw (30) normally but not always with a drilled hole in splined end (34). The helical spring is biased or under tension when the profile rollers are in the operating position.

As soon as the machine tool slide holding the thread rolling head reaches a preset location on the workpiece, the axial or feed movement is stopped. As a result, the claw clutch is divided between the fixed and the movable claws. Once the claws separate, spring (10) under tension provides twisting of the spring housing (2). In this way, the center gear wheel (7) is caused to rotate and meshed small gears (8) are caused to rotate with attached eccentric shafts (5) also rotating to cause the profile rollers to open wider than the major diameter of the rolled thread or "pop" off the workpiece.

The thread rolling head can now be removed from the created thread without damage. Prior to starting a new thread, the thread rolling head must be twisted to the closed position with the two clutch claws seated together. Various means are available, including manually operated means such as pin (9) of prior art FIG. 1 of the '743 patent and cam handle (55) illustrated in FIG. 2 of the '087 patent, and the motor-driven means to which the '743 patent is directed. All require the twisting of spring housing (2) so that helical spring (10) is put under tension to cause the thread rollers to "pop" open after the next manufactured thread.

In this prior art, the distance between the thread rolling heads is increased to remove the workpiece from between the thread rollers. Typically, as described, this distance is increased by disengagement of the claw clutch followed by rotation of the eccentric shafts on which the thread rollers are arranged. Thereafter, the claw clutch of the thread rolling head must be re-locked.

SUMMARY OF THE INVENTION

In accordance with the purpose of the present invention, an axial thread rolling process is provided that utilizes an axial thread rolling head that includes a shank adapted to be mounted in a machine tool, and a clutch with a fixed shank portion. The thread rolling head further includes an axially movable, adjustment housing unit that includes the movable portion of the clutch, and that includes a plurality of thread rollers.

In accordance with the inventive process, the clutch is in a locked axial relative position, which is defined by the movable clutch portion being seated and engaged with the fixed clutch portion, or the clutch is in a partially engaged, axial relative position, which is defined by the movable clutch portion being partially engaged with the fixed clutch portion. Beneficially, the thread rolling head further includes a tension spring arranged to assist return of the clutch to the seated and engaged, axial relative position when the thread rollers are no longer in contact with a workpiece.

In accordance with the inventive process, the thread rolling process also utilizes means for reversing the direction of rotation used for thread rolling. As described below, either the direction of rotation of the thread rolling head is reversed, or the direction of rotation of the workpiece on which threads have been rolled, is reversed.

In an embodiment of the process when the reversing means of the machine tool controls the direction of rotation of the thread rolling head, the thread rolling head is rotatable and axially movable by, and under control of, the machine tool. In this embodiment, threads are rolled on a stationary workpiece at a controlled feed rate with the thread rolling head rotating in a first direction whereby the workpiece comprises threads rolled by, and in engagement with, the plurality of thread rollers, and whereby the movable clutch portion axially moves into the partially engaged, axial relative position.

In accordance with the inventive process, axial movement of the adjustment housing unit is limited whereby the shank clutch portion and the movable clutch portion are prevented from full disengagement.

In this embodiment, after completing the desired length of thread, the thread rolling head is rotated in a direction opposite to the first direction to follow the threads created, whereby the threaded workpiece escapes from the thread rollers without the clutch being fully disengaged, and whereby the movable clutch portion returns to the seated and engaged, axial relative position.

In an embodiment of the process when the shank of the thread rolling head is mounted in a machine tool but the reversing means controls the direction of rotation of the workpiece, the thread rolling head is axially movable by, and under control of, the machine tool. In this embodiment, threads are rolled at a controlled feed rate with the workpiece rotating in a first direction whereby the workpiece comprises threads rolled by, and in engagement with, the plurality of thread rollers, and whereby the movable clutch portion axially moves into the partially engaged, axial relative position.

As described, in accordance with the inventive process, axial movement of the adjustment housing unit is limited whereby the shank clutch portion and the movable clutch portion are prevented from full disengagement.

In this embodiment, after completing the desired length of thread, the workpiece is rotated in a direction opposite to the first direction to follow the threads created, whereby the threaded workpiece escapes from the thread rollers without the clutch being fully disengaged, and whereby the movable clutch portion returns to the seated and engaged, axial relative position.

In accordance with the invention, threads are rolled on the next workpiece without the need to manually manipulate the adjustment housing unit or employ other auxiliary locking systems to manipulate the adjustment housing unit, to re-lock the clutch.

Additional advantages and beneficial features of the present invention are set forth in the drawing and detailed description, and in part will become apparent to those skilled in the art upon examination of the drawing and detailed description or may be learned by practice of the invention. As will be realized, this invention is capable of other and different embodiments than those described, and its several details are capable of modification in various respects, all without departing from the invention. Furthermore, the drawing and the detailed description are to be regarded as illustrative in nature, and not as restrictive.

BRIEF DESCRIPTION OF THE DRAWING

Reference is now made to the accompanying drawing which forms a part of the specification of the present invention.

DETAILED DESCRIPTION OF THE INVENTION

Definitions

Figure 1:
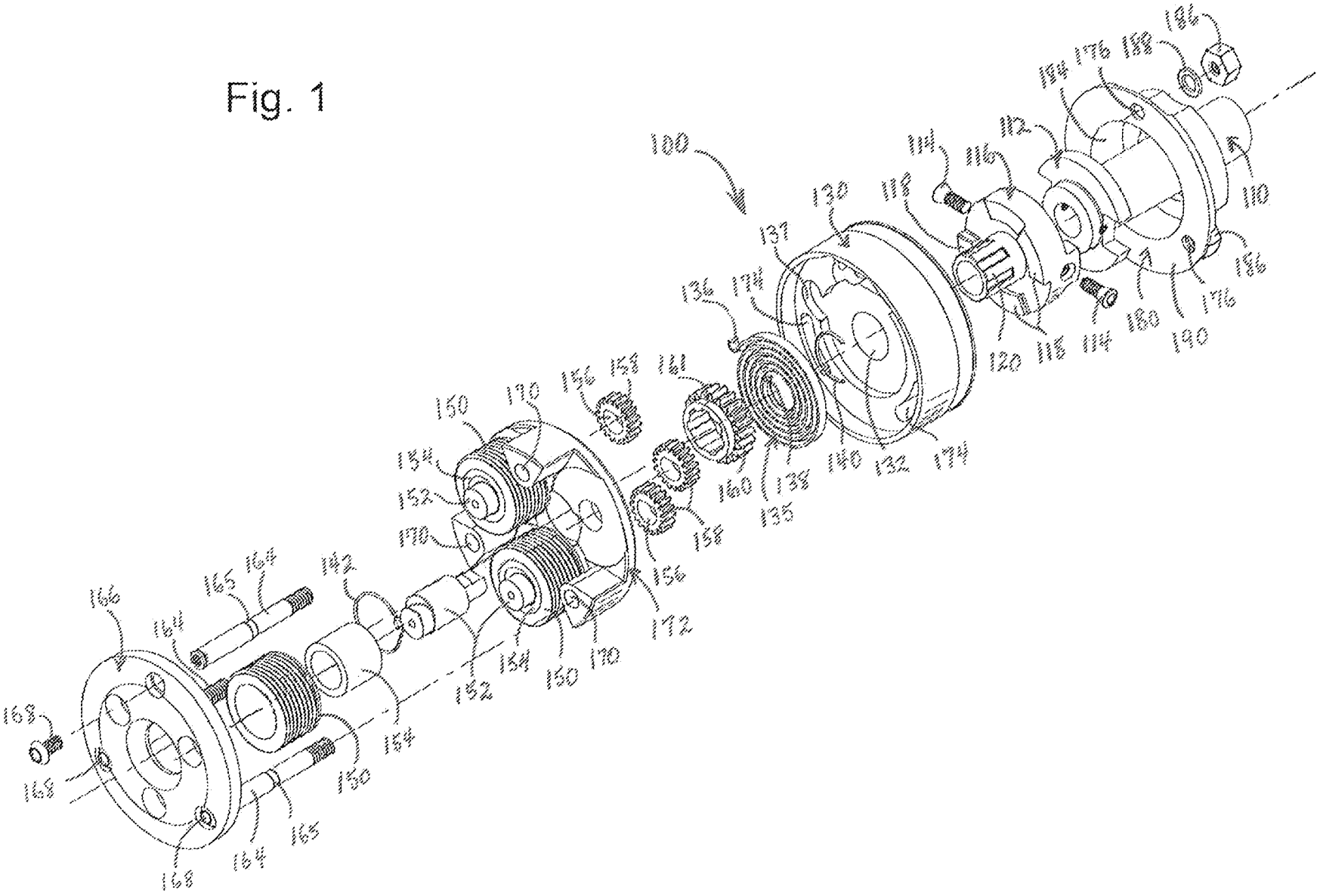
FIG. 1 shows an exploded view of a preferred embodiment of an axial thread rolling head useful in accordance with the present invention.

"Thread pitch" is 1/number of threads per inch.

"Feed rate" is the rate at which threads are rolled into a workpiece, and in the case of a rotating workpiece, is the axial feed of a thread rolling head per revolution of the workpiece.

In addition, in the description of the invention, relative terms such as "upper", "lower", "forward", "rear" and the like, have been used particularly with reference to the drawing to assist understanding.

During thread rolling, the workpiece material is displaced and forced into the space between the rollers. This space does not equal the material displaced. The excess is "squeezed" out with the finished thread and in fact the material stretches, normally about 2-5% in length. This error from stretch is called thread lead error and thread standards allow more than occurs.

After the thread is formed, the workpiece material cools and gets hard again. It was found that rolling off the hardened material frequently caused thread damage, but that by allowing the clutch to partially open, damage could be prevented.

In the foregoing prior art, an adjustment pin or the like must be used to reverse the rotation of spring housing (2) and re-lock the claw clutch after the clutch claws become separated during the "pop off" end of the thread rolling a workpiece. In accordance with the present invention, an adjustment pin or the like is not needed because the clutch is limited in the extent of axial separation and thus does not become fully disengaged. Thus, the present invention provides an axial thread rolling process by which a workpiece is removed from the thread rolling head and the thread rollers, without the clutch being fully disengaged. Accordingly, it is unnecessary before starting a new working cycle, to re-lock a fully disengaged clutch as the tension spring will assist closing the partially disengaged clutch after or as the workpiece escapes from the thread rollers. As described infra, a workpiece is removed from a thread rolling head by reversing the direction of rotation. A failsafe process uses a structural element that physically limits the extent of clutch disengagement.

A thread rolling head useful in the present invention includes a shank and a adjustment housing unit that are interconnected by a clutch. To this end, the shank includes a fixed part of the clutch and the adjustment housing unit includes a movable part of the clutch. The shank and fixed clutch part may be one piece as illustrated by prior art FIG. 1 of the '743 Patent, or may be a combination of two or more pieces as illustrated by FIG. 1 of the present invention. Regardless, the fixed part of the clutch is the shank part of the clutch.

Figure 2:
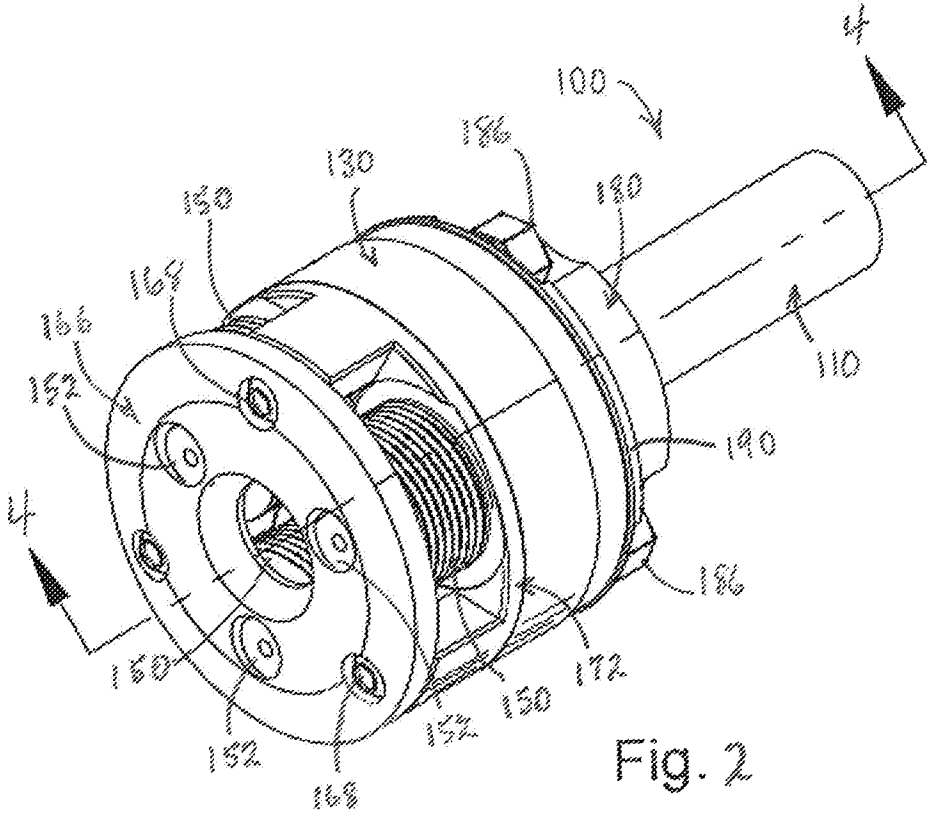
FIG. 2 is an enlarged perspective view of the assembled thread rolling head of FIG. 1.

Reference is made to FIGS. 1 and 2, which illustrate a preferred embodiment of an axial thread rolling head useful in accordance with the present invention. Thread rolling head 100 comprises an adjustment housing unit (described infra) and a shank 110 adapted to be secured in a machine tool. The shank which, for example, may be clamped into a computerized numerically controlled (CNC) machine tool, comprises a cylindrical shank portion 112 with keyways for attachment to the shank. Cylindrical shank portion 112 is beneficially secured by screws 114 to a mating cylindrical shank portion 116 that includes a clutch claw 118 of a claw clutch of thread rolling head 100, and a splined cylindrical shank end 120.

An advantage of the shank being made of multiple components is that the shank can be changed out to increase the usefulness of the thread rolling head. Different tool machines have different size mounting openings. Replaceable shanks eliminate the use of sized collars.

The adjustment housing unit of thread rolling head 100 includes an adjustment housing 130 with a central bore 132, which is arranged on splined cylindrical end 120 of the shank. Adjustment housing 130 includes a clutch claw 134 (see FIGS. 4 and 5) on its back that cooperates with clutch claw 118 of the shank.

Referring to FIG. 1 in particular, the adjustment housing 130 includes a helical spring 135, an outer end 136 of which cooperates with a slot 137 of the adjustment housing, and an inner end 138 of which is connected to (not shown) typically a hole in splined cylindrical shank end 120. Snap ring 140 snaps on the splined cylindrical shank end after insertion of the splined shank end through housing 130. Snap ring 142 snaps on shoulder 161 of center gear 160 after the center gear shoulder is inserted through the center bore of center plate 172, thus allowing the portion of thread rolling head 100 forward of fixed clutch claw 118 to move axially during the thread rolling process allowing partial separation of the fixed and movable clutch claws.

The adjustment housing unit also includes three thread rolls 150, although two may be used on smaller thread rolling heads. If needed or appropriate, more than three thread rolls may be used. Each thread roll is supported on an eccentric shaft 152 with carbide bushings 154 advantageously disposed between. Alternatively, with respect to prior art FIG. 1, bearings may be disposed between.

With continued reference to FIG. 1, at the rear end, each eccentric shaft 152 is flattened, the flattened end cooperating with a correspondingly formed bore 156 of gear wheels 158, which mesh with central gear wheel 160. The central gear wheel is mounted on splined cylindrical end 120 of the shank, and the bore of the central gear wheel slides on the splined cylindrical end.

The adjustment housing unit also includes a front plate 166 to which spacer studs 164 are secured by cap screws 168. Each of studs 164 includes a thread portion that extends through a positioning bore 170 of a center plate 172. The thread portion of each stud 164 also extends through bow-shaped elongated holes 174 of housing 130 and through bores 176 of a cylindrical cap 180. Locking nuts and, as needed, washers 186, 188 affix housing 130, center plate 172 and cap 180 to front plate 166. Beneficially, a shoulder 165 of each stud maintains roller clearance between center plate 172 and front plate 166. The relative position of rotation of housing 130 is adjustable before tightening nuts 186. For this purpose, a scale (not shown) is typically provided on an exterior surface of housing 130.

Figure 3:
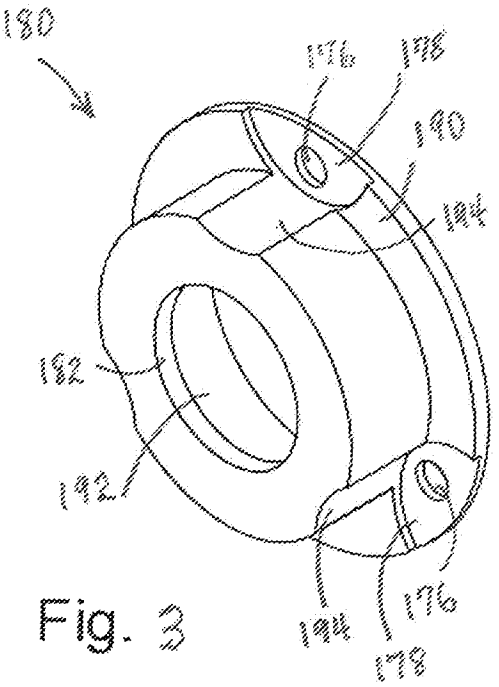
FIG. 3 is an enlarged reverse perspective view of the end cap of the thread rolling head of FIG. 1.

Referring in particular to FIGS. 1 and 3, cylindrical cap 180 is provided with a central bore 182 through which shank 110 extends, and with a larger bore 184 that fits around shank portions 112, 116. When using cap 180, which includes a cylindrical flange 190, a dust ring may be omitted. See ring (16) in prior art FIG. 1, for example. The cap is bolted on the thread rolling head by removing the locking nuts and washers. To assist removal and tightening of the locking nuts, the external surface of the cap is advantageously provided with arcuate recesses 194, and flange 190 is likewise provided with recessed areas 178.

Figure 4:
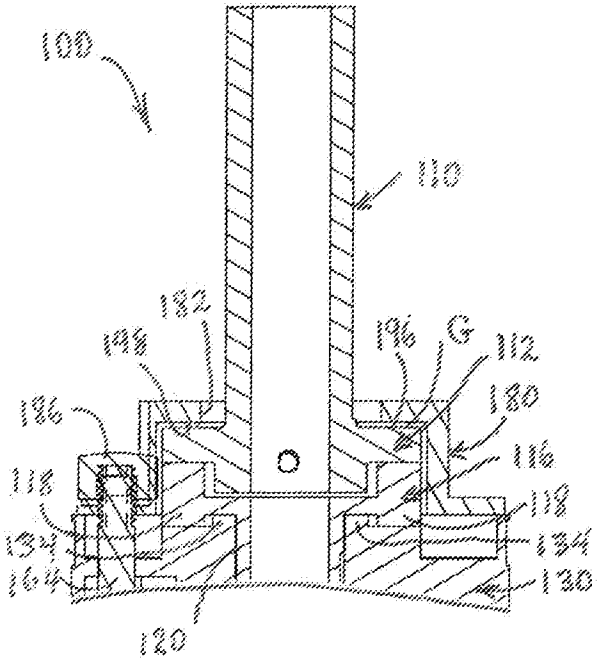
FIG. 4 is a partial cross-sectional view taken substantially along line 4-4 of FIG. 2, with the clutch seated and engaged.

With reference to FIG. 4, in the locked position of the clutch, a gap G exists between an underlying surface 196 of shank portion 112 and an upper inside surface 198 of cap 180, and there is no gap between the fixed and movable clutch claws. In the failsafe partially disengaged position illustrated in FIG. 5, underlying surface 196 of shank portion 112 contacts upper inside surface 198 of the cap to prevent the clutch from fully disengaging, and a gap G' exists between the fixed and movable clutch claws. In a preferable partially disengaged clutch position, a gap exists between the surface underlying the cap and the upper inside surface of the cap, as well as between the fixed and movable clutch claws.

Figure 5:
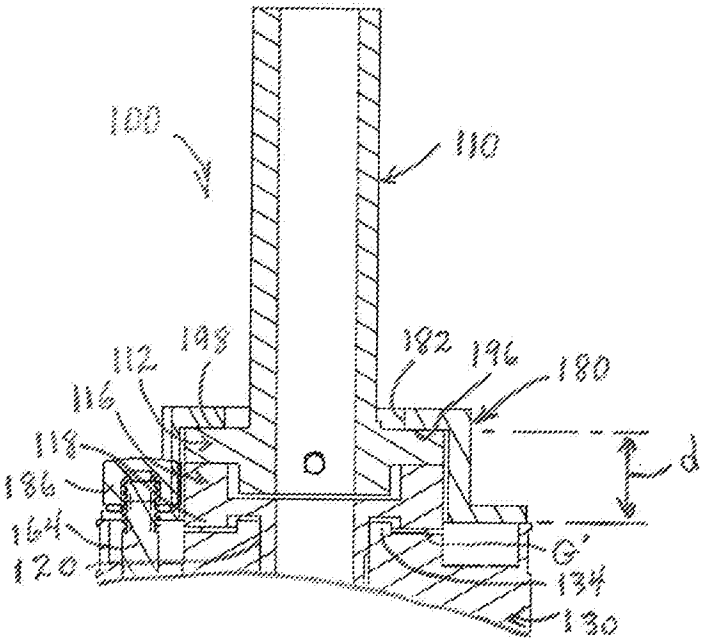
FIG. 5 is a like partial cross-sectional view that illustrates the clutch of the thread rolling head of FIG. 2 partially disengaged, with some details omitted for clarity.

With reference to FIGS. 3 and 5, a depth d of interior wall 192 of cap 180 defines the height of upper inside surface 198 of the cap. Depth d will beneficially not exceed 80% of the clutch disengagement value.

Other embodiments of thread rolling heads may be used, and may vary in a number of ways from the embodiment described. However, common elements include a disengageable clutch where the fixed portion is affixed to or part of the shank and the movable portion is affixed to or part of the adjustment housing, and beneficially include a tension spring arranged to assist return of the clutch to the seated and engaged, axial relative position.

In one such thread rolling head embodiment, the axially fixed clutch claw includes three legs that extend generally perpendicularly from the shank and that are spaced about 120 degrees apart. For that embodiment, a cap useful in the invention fits over the three shank legs, and surface of the shank legs underlying the cap would, in a failsafe position, contact upper inside surface of the cap.

The inventive process allows the clutch to partially separate but never fully. Each clutch has an axial value of movement to disengage ("the clutch disengagement value"). This value divided by the thread pitch equals the number of revolutions before in accordance with the invention, the direction of rotation needs to be reversed. Using known clutch separation value(s) of various useful thread rolling heads, the inventive technology beneficially allows less than, but blocks more than, 80% separation of the clutch.

A beneficial feed rate is the pitch less a calculated amount, further described infra. The calculated amount will preferably be determined to prevent an extent of clutch separation that results in axial movement-limiting contact of a surface underlying a cap useful in the present invention, with an upper inside surface of the cap.

During creation of the thread, the thread rollers move axially within the space allowed by the extent of clutch separation. At the completion of the desired thread length, the rotating member is reversed. The partially separated clutch claws return to the full closed position. Any inconsistencies between RPM and axial feed rate during thread creation will beneficially be compensated for. Importantly, thread quality will not be impacted by the roll-off.

In accordance with the invention and referring to the drawing, the thread rolling head, if not closed, is twisted closed to force shank clutch claw 118 and clutch claw 134 on the back of housing 130 into seated engagement with each other ("the locked position"; see FIG. 4). When using a commercially available thread rolling head that includes externally accessible clutch closing aids, such as the device of prior art FIG. 3 of the '743 Patent, the head is modified by removing the no longer needed, externally accessible clutch closing aids.

As explained in the Background of the Invention, and again referring to the drawing, thread rollers 150 are loaded on eccentric shafts 152, and the thread rollers are spaced apart from each other a preset distance and tightened in position. After the shank is secured to a machine tool, the shank and the shank clutch claw become fixed, and the thread rolling head is under machine tool axis control by various methods dependent on machine tool design. The thread rolling head is positioned on the axial or centerline of the machine tool.

The thread rolling head can move axially under machine tool control. The thread rolling head (either rotating or non-rotating) is fed under controlled feed rate into the workpiece. The feed rate is beneficially calculated to be the thread pitch less normally approximately 0.0005" with feed rate adjustment made for length of thread and workpiece material. After approximately 1.5 to 3 rpms, the workpiece material changes state and experiences plasticity, and the rollers then "pull" through the material based on the ground pitch in the rollers.

By feeding at the thread pitch less 0.0005", the clutch is allowed to partially separate during the inventive process by a value less than the clutch disengagement value, and preferably less than results in contact with an axial movement-limiting element such as cap 180. Partial separation of the fixed clutch claw and movable clutch claw on the back of the adjustment housing will occur but never fully. The partial disengagement compensates for discrepancy in RPM and axial feed rate.

Without the extent of axial movement during partial clutch disengagement that the inventive process allows, rolling off the hardened material during the inventive process would cause damage. Because the thread is formed into the workpiece when rolling on, feed rate and rpm discrepancies are overcome by partial clutch separation so the rollers will roll off in the path created while rolling on. Thus, the invention allows the thread rollers to follow the thread when reversing or rolling off.

After the desired length of thread is generated, the user stops feeding the tool; however, the adjustment housing unit continues moving. With continued reference to the drawing, with the fixed claw axially stationary and the movable clutch claw continuing to move with housing 130, the movable and fixed claws separate further, but only partially. Because the fixed clutch claw and movable clutch claw are prevented from fully separating, gear wheels (158) and eccentric shafts (152) do not rotate, and the distance between the thread rolls does not change.

The direction of rotation is beneficially reversed. The machine tool controlling the thread rolling head, may include means for rotating the thread rolling head clockwise and counterclockwise, or when the workpiece is controlled by a machine tool capable of rotating the workpiece clockwise and counterclockwise, the machine tool controlling the workpiece includes means for reversing the direction of rotation. In either case, the machine tool providing the clockwise and counterclockwise rotation, typically includes a clutch and associated gears.

In either case, the direction of rotation is beneficially reversed in typically 1 to 3 rpms to the starting point of the thread manufacturing process whereby the workpiece escapes from the thread rolling head, and thereby also closing the space between the movable and fixed clutch claws. The closing of the space between the clutch claws during reversal of the direction of the rotating member, prevents damage to the threads created. The rolling head is controlled and follows the threads created, without thread damage. The reversal of direction may beneficially be at generally the same feed rate the thread was created.

Beneficially, the thread rolling process may include an axial movement-restricting cap such as cap 180. When calculating thread pitch, the larger the denominator (TPI), the smaller the clutch separation value, which results in more RPM's to reverse. With cap 180, the movable clutch claw is structurally limited in axial movement as a result of contact of an underlying surface 196 of shank portion 112 with an upper inside surface 198 of the cap, which prevents the clutch from fully disengaging. If the head is in the clutch closed position without the cap, eventually the rollers may open from a courser pitch thread or fatigue of the rollers and/or of the reversing means. When this happens, unusable parts will be made in an automatic manner since there is no clutch closing strategy. Using an element such as cap 180, that limits axial movement of the movable claw clutch, is a failsafe to prevent making scrap.

Various modifications and combinations have been described. The present invention may be carried out with other modifications and/or combinations without departing from the spirit or essential attributes thereof. Accordingly, reference should be made to the appended claims as indicating the scope of the invention.

The invention claimed is:

1. A thread rolling process that utilizes 1) an axial thread rolling head comprising
   a shank adapted to be mounted in a machine tool,
   a clutch with a fixed shank portion, and
   an axially movable adjustment housing unit comprising a movable portion of the clutch, and comprising a plurality of thread rollers, wherein in a locked axial relative position, the movable clutch portion is seated and engaged with the fixed clutch portion, and in a second axial relative position, the movable clutch portion is partially engaged with the fixed clutch portion, and 2) means for reversing the direction of rotation used for thread rolling, wherein said reversing means controls the direction of rotation of the thread rolling head, and wherein said thread rolling process comprises mounting the thread rolling head shank in said machine tool, said thread rolling head being rotatable and axially movable by, and under control of, said machine tool, rolling threads on a stationary workpiece at a controlled feed rate with the thread rolling head rotating in a first direction whereby said workpiece comprises threads rolled by, and in engagement with, said plurality of thread rollers, and whereby the movable clutch portion axially moves into the partially engaged, axial relative position, limiting axial movement of said adjustment housing unit in said first direction whereby said fixed clutch portion and said movable clutch portion are prevented from full disengagement, after completing the desired length of thread, rotating said thread rolling head in a direction opposite to said first direction to follow the threads created, whereby the threaded workpiece escapes from the thread rollers without full disengagement of the clutch, and whereby said movable clutch portion returns to the seated and engaged, axial relative position, and rolling threads on the next workpiece without the need to use auxiliary locking means to manipulate the adjustment housing unit, to re-lock the clutch.

2. The thread rolling process of claim 1, wherein said adjustment housing unit further includes a tension spring arranged to assist the return of the movable clutch portion to said seated and engaged, axial relative position.

3. The thread rolling process of claim 1, wherein said thread rolling head further comprises a cap comprising a bore disposed around said shank, said cap being affixed to said axially movable; adjustment housing unit, whereby the full clutch disengagement is prevented without contact of the cap and a shank surface underlying the cap.

4. The thread rolling process of claim 3, wherein said cap is a cylindrical cap that comprises said bore and a bore disposed around said fixed clutch portion.

5. The thread rolling process of claim 1, wherein said thread rolling head further comprises a cap comprising a bore disposed around said shank, said cap being affixed to said axially movable adjustment housing unit, whereby the full clutch disengagement is prevented by contact of upper inside surface of said cap and a shank surface underlying said cap.

6. The thread rolling process of claim 1, further comprising prior to mounting said shank in said machine tool, retrofitting said axial thread rolling head with a cap comprising a bore sized to fit around said shank, by affixing said cap to said adjustment housing unit, and removing all externally accessible clutch closing aids.

7. The thread rolling process of claim 1, wherein when said thread rolling head is rotated in said direction opposite to said first direction, the thread rolling head is rotated at a controlled rate that is generally the same as the feed rate used for the thread rolling.

8. The thread rolling process of claim 1, wherein said machine tool is a CNC machine that provides the rotation of the thread rolling head in either direction.

9. The thread rolling process of claim 1, whereby the full clutch disengagement is prevented by reversing the direction of rotating said thread rolling head from said first direction to said direction opposite to said first direction.

10. A thread rolling process that utilizes 1) an axial thread rolling head comprising
   a shank adapted to be mounted in a machine tool,
   a clutch with a fixed shank portion, and
   an axially movable adjustment housing unit comprising a movable portion of the clutch, and comprising a plurality of thread rollers, wherein in a locked axial relative position, the movable clutch portion is seated and engaged with the fixed clutch portion, and in a second axial relative position, the movable clutch portion is partially engaged with the fixed clutch portion, and 2) means for reversing the direction of rotation used for thread rolling, wherein said reversing means controls the direction of rotation of a workpiece, and wherein said thread rolling process comprises mounting the thread rolling head shank in said machine tool, said thread rolling head being axially movable by, and under control of, said machine tool, rolling threads at a controlled feed rate on a workpiece rotating in a first direction whereby said workpiece comprises threads rolled by, and in engagement with, said plurality of thread rollers, and whereby the movable clutch portion axially moves into the partially engaged, axial relative position, limiting axial movement of said adjustment housing unit in said first direction whereby said fixed clutch portion and said movable clutch portion are prevented from full disengagement, after completing the desired length of thread, rotating said workpiece in a direction opposite to said first direction at a controlled rate to follow the threads created, whereby the threaded workpiece escapes from the thread rollers without full disengagement of the clutch, and whereby said movable clutch portion returns to the seated and engaged, axial relative position, and rolling threads on the next workpiece without the need to use auxiliary locking means to manipulate the adjustment housing unit, to re-lock the clutch.

11. The thread rolling process of claim 10, wherein said adjustment housing unit further includes a tension spring arranged to assist the return of the movable clutch portion to said seated and engaged, axial relative position.

12. The thread rolling head process of claim 10, wherein said thread rolling head further comprises a cap comprising a bore disposed around said shank, said cap being affixed to said axially movable adjustment housing unit, whereby the full clutch disengagement is prevented without contact of said cap and a shank surface underlying said cap.

13. The thread rolling process of claim 12, wherein said cap is a cylindrical cap that comprises said bore and a bore disposed around said fixed clutch portion.

14. The thread rolling head process of claim 10, wherein said thread rolling head further comprises a cap comprising a bore disposed around said shank, said cap being affixed to said axially movable adjustment housing unit, whereby the full clutch disengagement is prevented by contact of upper inside surface of said cap and a shank surface underlying said cap.

15. The thread rolling head process of claim 10, further comprising prior to mounting said shank in said machine tool, retrofitting said axial thread rolling head with a cap comprising a bore sized to fit around said shank, by affixing said cap to said adjustment housing unit, and removing all externally accessible clutch closing aids.

16. The thread rolling head process of claim 10, wherein when said workpiece is rotated in said direction opposite to said first direction of rotation, the workpiece is rotated at a controlled rate that is generally the same as the feed rate used for the thread rolling.

17. The thread rolling process of claim 10, whereby the full clutch disengagement is prevented by reversing the direction of rotating said workpiece from said first direction to said direction opposite to said first direction.

* * * * *